US005788573A

United States Patent [19]

Baerlocher et al.

[11] Patent Number: 5,788,573

[45] Date of Patent: Aug. 4, 1998

[54] ELECTRONIC GAME METHOD AND APPARATUS WITH HIERARCHY OF SIMULATED WHEELS

[75] Inventors: Anthony J. Baerlocher, Carson City; Robert W. Crowder, Jr., Reno, both of Nev.

[73] Assignee: International Game Technology, Reno, Nev.

[21] Appl. No.: 620,586

[22] Filed: Mar. 22, 1996

[51] Int. Cl.[6] ..... A63F 9/24; A63F 5/00

[52] U.S. Cl. ..... 463/16; 463/26; 463/25; 463/9; 273/138.2

[58] Field of Search ..... 463/1, 9, 12, 13, 463/16, 20, 25, 26, 27, 30, 31, 36, 40–42; 364/410, 412; 273/139, 143 R, 138.2, 138.1

[56] References Cited

U.S. PATENT DOCUMENTS

| | | | |
|---|---|---|---|
| 4,448,419 | 5/1984 | Telnaes | 273/143 R |
| 4,711,451 | 12/1987 | Pajak et al. | 273/143 R |
| 4,805,907 | 2/1989 | Hagiwara | 463/42 |
| 4,837,728 | 6/1989 | Barrie et al. | 463/27 |
| 4,964,638 | 10/1990 | Ishida | 463/27 |
| 4,998,199 | 3/1991 | Tashiro et al. | 463/42 |
| 5,102,134 | 4/1992 | Smyth | 273/143 R |
| 5,188,363 | 2/1993 | Marnell, II et al. | 463/13 |
| 5,209,479 | 5/1993 | Nagao et al. | 273/143 R |
| 5,259,616 | 11/1993 | Bergmann | 273/138 A |
| 5,344,144 | 9/1994 | Canon | 273/138 A |
| 5,393,061 | 2/1995 | Manship et al. | 463/20 |
| 5,409,225 | 4/1995 | Kelly et al. | 273/138 R |

FOREIGN PATENT DOCUMENTS

| | | | |
|---|---|---|---|
| 632454 | 12/1992 | Australia | G07F 17/32 |
| 2 086 632 | 5/1982 | United Kingdom | G07F 17/34 |
| 2 201 821 | 9/1988 | United Kingdom | G07F 17/34 |

OTHER PUBLICATIONS

"Old ideas make new ideas", *Loose Change*, Sep. 1996, pp. 22–24.

*Primary Examiner*—Jessica Harrison
*Assistant Examiner*—Mark A. Sager
*Attorney, Agent, or Firm*—Sheridan Ross P.C.

[57] ABSTRACT

A computer implemented electronic game includes a wheel of fortune game with odds of a jackpot greatly in excess of the number of indicia on a simulated wheel. In one embodiment, a virtual mapping allows a bonus indicium of the wheel to be given a 1:M chance of being landed on, even though the bonus position is one of N positions on the simulated wheel. A random number L is chosen between 1 and M and this number is mapped to a number between 1 and N. The display of the wheel if controlled to simulate stopping of the wheel at the Ith indicium where L is mapped to I. In one embodiment, by using successive wheel spins, the odds of moving to the next round are multiplied to achieve an overall odds of winning a jackpot. In one embodiment there is a 1:50 chance of entering a bonus screen from a main slot machine/phrase completion screen, a 1:20 chance of landing on a bonus position in a first wheel spin, a 1:40 chance of landing on a bonus position for a second wheel spin and a 1:200 chance of landing on a bonus position for a last wheel spin to provide an overall odds of a jackpot of 1:8 million.

16 Claims, 7 Drawing Sheets

3
2
1
W
E
L
602c
602b
602a
608c
608b
608a
204
604
606
25¢
JACKPOT
$ 1,000,953.99
GAME OVER
HELP
CATEGORY: QUOTE
BONUS 30000
CREDITS 1200
500 PAID

ELECTRONIC GAME METHOD AND APPARATUS WITH HIERARCHY OF SIMULATED WHEELS

A present invention relates to an electronically implemented gaming device and in particular to a computer implemented "Wheel of Fortune" game.

BACKGROUND INFORMATION

Among various devices which have been used for gaming, even before the electronic age, is a wheel of fortune which typically involves a disk or wheel rotatable in a vertical plane with a plurality of numbers, symbols or other indicia positioned on the face of the wheel near its perimeter. A stationary pointer, such as a flexible resilient flipper, is configured to point to an indicium when the wheel is stationary. In one use, players place wagers on which indicium the flipper will point to when the wheel comes to rest after having been manually spun.

A number of games incorporating a wheel of fortune have been devised, including a televised game titled "Wheel of Fortune" which combines a spin of a wheel of fortune with players' attempts to complete and/or guess at a hidden phrase by choosing, winning or buying letters of the alphabet which are revealed to the players if contained in the hidden phrase.

SUMMARY OF THE INVENTION

The present invention includes a recognition of problems found in previous devices. One of the problems with a traditional wheel of fortune is that the number of possible indicia (and thus the maximum possible odds of winning) are limited by the physical size of the wheel. In some gaming environments, it is desired to provide a game which permits relatively small wagers but provides a potential for relatively large prizes. The popularity of so-called progressive games demonstrates the attractiveness of this type of gaming environment. However, the combination of small wagers and large prizes typically means that the odds of winning based on any one wager must be small, such as one in one million, more preferably one in five million, and even more preferably one in eight million or more. Previous traditional wheel of fortune games are not capable of providing these types of odds.

Accordingly, it would be advantageous to provide a game which incorporates features of a traditional wheel of fortune game but which is compatible with small prize odds such as odds of one in one million or more.

According to one embodiment of the invention, rather than providing an actual physical wheel, an electronic wheel, preferably a video image controlled by a computer, is provided. Preferably, as with the traditional physical wheel of fortune, the ending configuration of the simulated wheel, after any one spin, is a random event. However, unlike a traditional, physical wheel of fortune in which the ending position, is determined by physical factors such as starting position, rotational velocity, friction, and the like, randomness in the simulated wheel is provided by a computer process such as a random number generator or pseudo-random number generator. In one embodiment, the simulated wheel, just as with a traditional physical wheel, is provided with a plurality of indicia. Unlike the traditional wheel, however, in which the wheel indicia are provided with predetermined, typically even, spacing, such that odds of landing on any given indicium are determined by the total number of indicia, in one embodiment of the present invention, odds are determined by the number of integers in a first range of integers mapped to the indicia. The number of integers in the first range may be different from the number of indicia on the simulated wheel. For example, in an evenly spaced physical wheel with 24 indicia, the odds of landing on any one indicium would be 1 in 24. However, in the present invention, even if the simulated wheel has 24 indicia which are evenly spaced, the odds of landing on any given indicium are determined by the size of the integer range mapped to the wheel and the number of integers mapped to any given indicium on the simulated wheel and thus may be different from 1 in 24.

In another embodiment, it may be desired to change, replace or otherwise modify indicia on a simulated wheel, e.g., during the spinning of the simulated wheel. In this way, even though it may be desired to provide only N indicium locations on the simulated wheel, the simulated wheel may be provided with m possible indicia by "swapping" new indicia onto the wheel during simulated spinning.

It should be understood that it is possible to use physical wheels for implementing the game of this invention. A physical wheel would require a corresponding virtual wheel in the computer memory of the machine. The number of positions in the virtual wheel is equal to or exceeds the number of positions on the physical wheel. The virtual positions are then mapped to the physical wheel positions permitting the odds of hitting a particular physical position to change without changing the size of, or number of physical positions on the wheel. The virtual wheel is analogous to the virtual reel invention for slot machine reels disclosed in U.S. Pat. No. 4,448,419 to Telnaes and assigned to International Game Technology. For purposes of this application, the use of the term simulated wheel or video screen wheel shall include physical wheels having corresponding virtual wheels in the computer memory of the device.

Traditional wheels of fortune were provided as isolated devices wherein the outcome of one wheel was unrelated to the operation of another wheel. In one embodiment of the present invention, a wheel which provides the potential for winning a large or jackpot prize can only provide such a win if the player has previously achieved a predefined result on a previous spin of another wheel. In one embodiment, the previous wheel need not provide an opportunity for a jackpot win. In this situation, the odds of winning a grand prize or jackpot on the second wheel spin is the product of the odds of landing on a jackpot-indicating indicium on said second simulated wheel times the odds of obtaining the predefined result on the previous wheel, providing a hierarchy of wheels of fortune wherein the result from one wheel spin has an effect on the other wheel spin. Thus, in one embodiment, a game provides for two or more different wheel spins in order to win a grand prize, providing odds of winning the grand prize which is a product of odds on two or more different spins and thus diminishing the overall odds.

DETAILED DESCRIPTION OF THE PREFERRED EMBODIMENTS

The present invention involves an electronically-implemented game method and apparatus, preferably a computer-implemented game. It is anticipated that a game according to the present invention will be played in a context in which monetary wagering is involved, typically in a casino or similarly regulated environment. As will be clear to those of skill in the art, the game can also be played in other environments such as personal computer (PC) game playing, video arcade environments, networked or other remote environments including Internet environments, local area networks, wide area networks and the like, and can involve either monetary wagering, wagering using physical or electronic tokens, credits and the like, or play without wagering such as for amusement purposes.

In one embodiment, the game is implemented on an electronic gaming terminal which includes a programmable controller or computer. The computer may be coupled to various output devices preferably including a display screen for displaying aspects of the game as described more thoroughly below. Other output devices may include audio outputs such as speakers, bells, whistles and the like, and signaling devices such as controllable lights and the like. A number of types of input devices can be used by which the user can place wagers and/or play the game, including touch screen input devices, joysticks, mouse input devices, keyboards, buttons, levers and the like, as well as coin or currency acceptors and/or validators, card readers such as credit card readers, or other encoded-card readers. In one embodiment, gaming terminals may be provided with communication devices, e.g., for purposes for accounting, maintenance, management, security, controls, updating and the like. It is common in the gaming industry to provide for electronic gaming terminals and those with skill in the art will understand how to construct and program such gaming terminals to implement the game according to the present invention after reading and understanding the present description.

Figure 1:
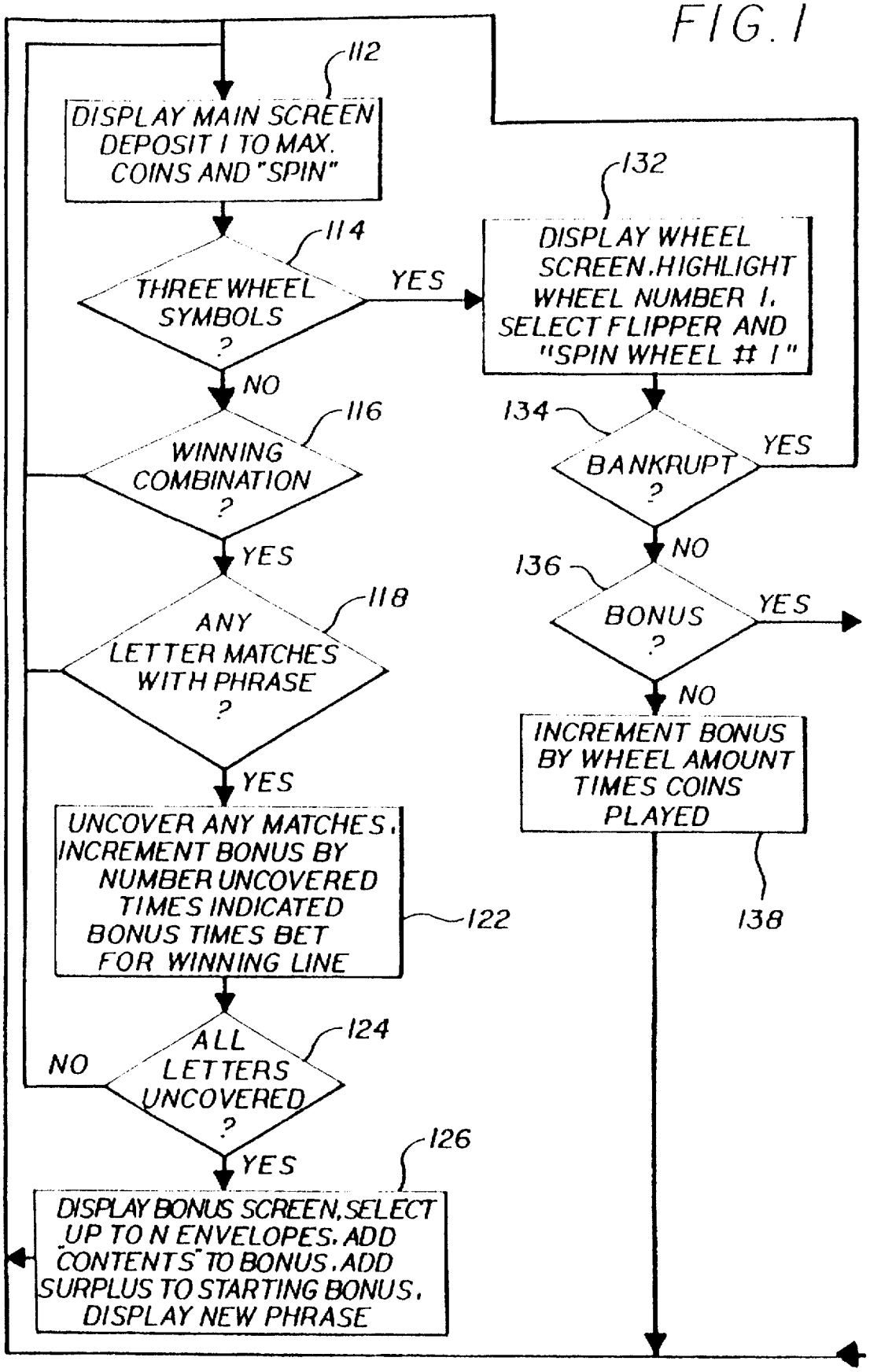
FIG. 1 is a flow chart describing a procedure for a wheel of fortune simulated game according to an embodiment of the present invention.
Figure 1:
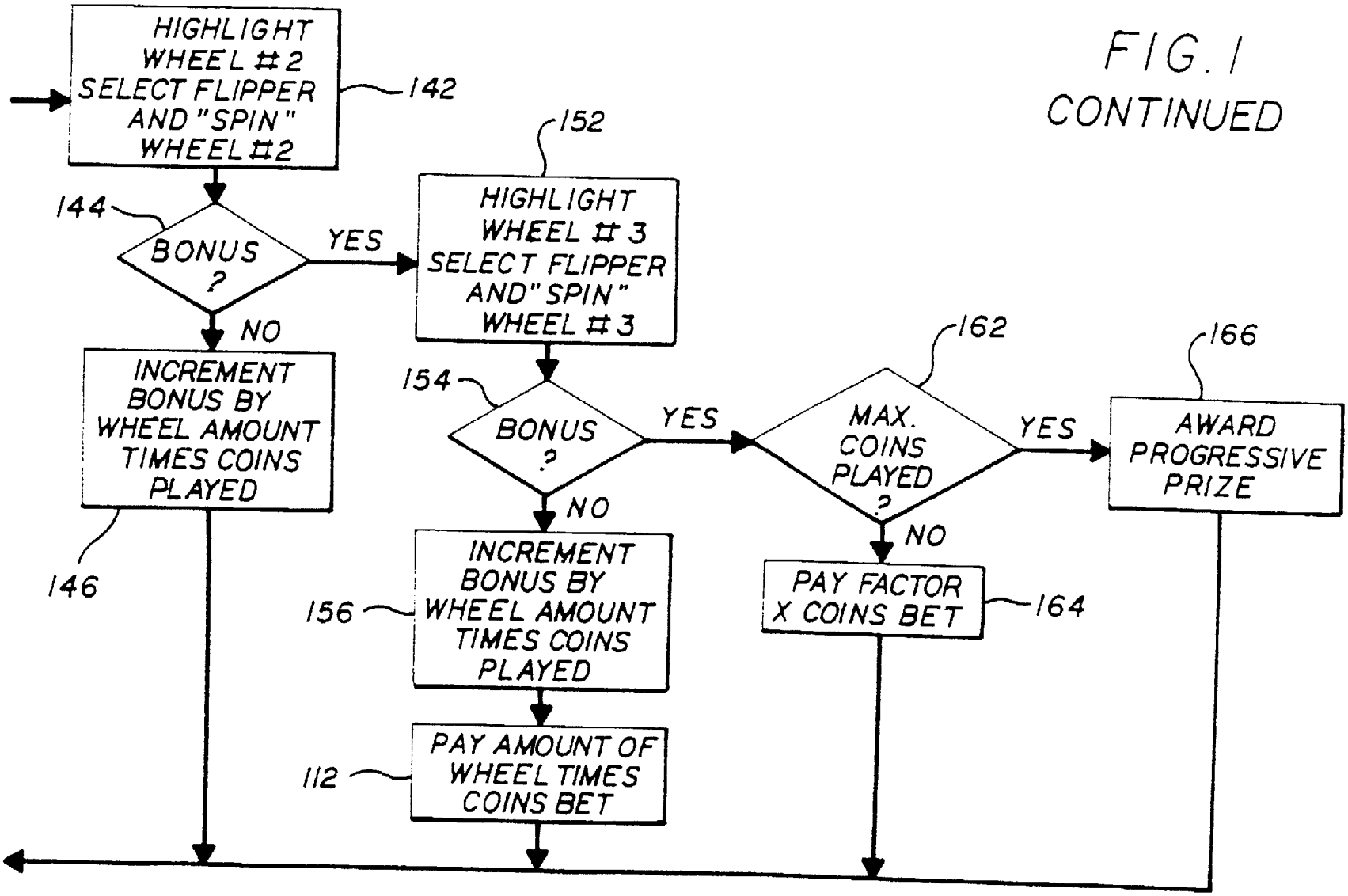
Figure 2:
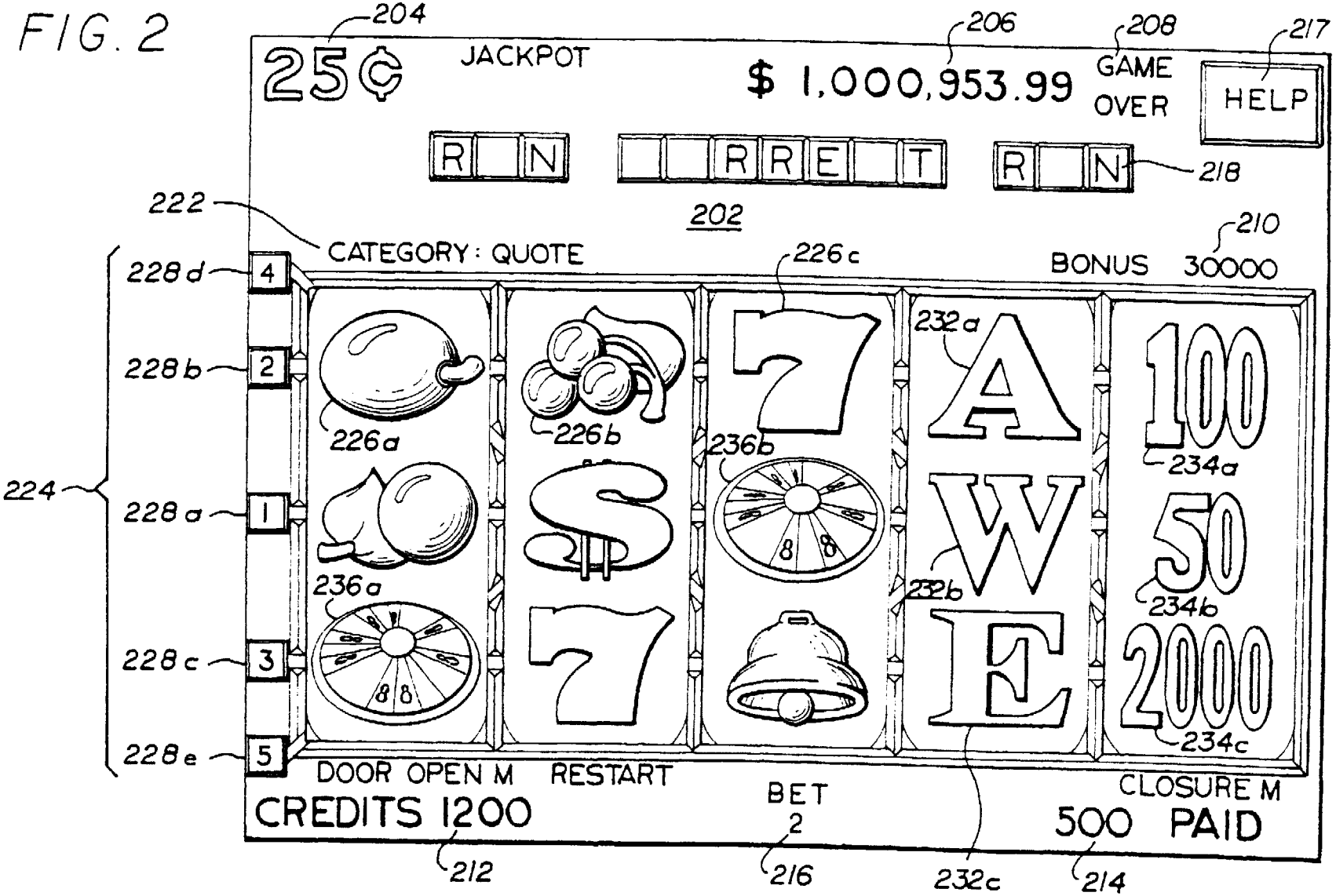
FIG. 2 shows a display screen during the first portion of game play according to an embodiment of the present invention.
Figure 3:
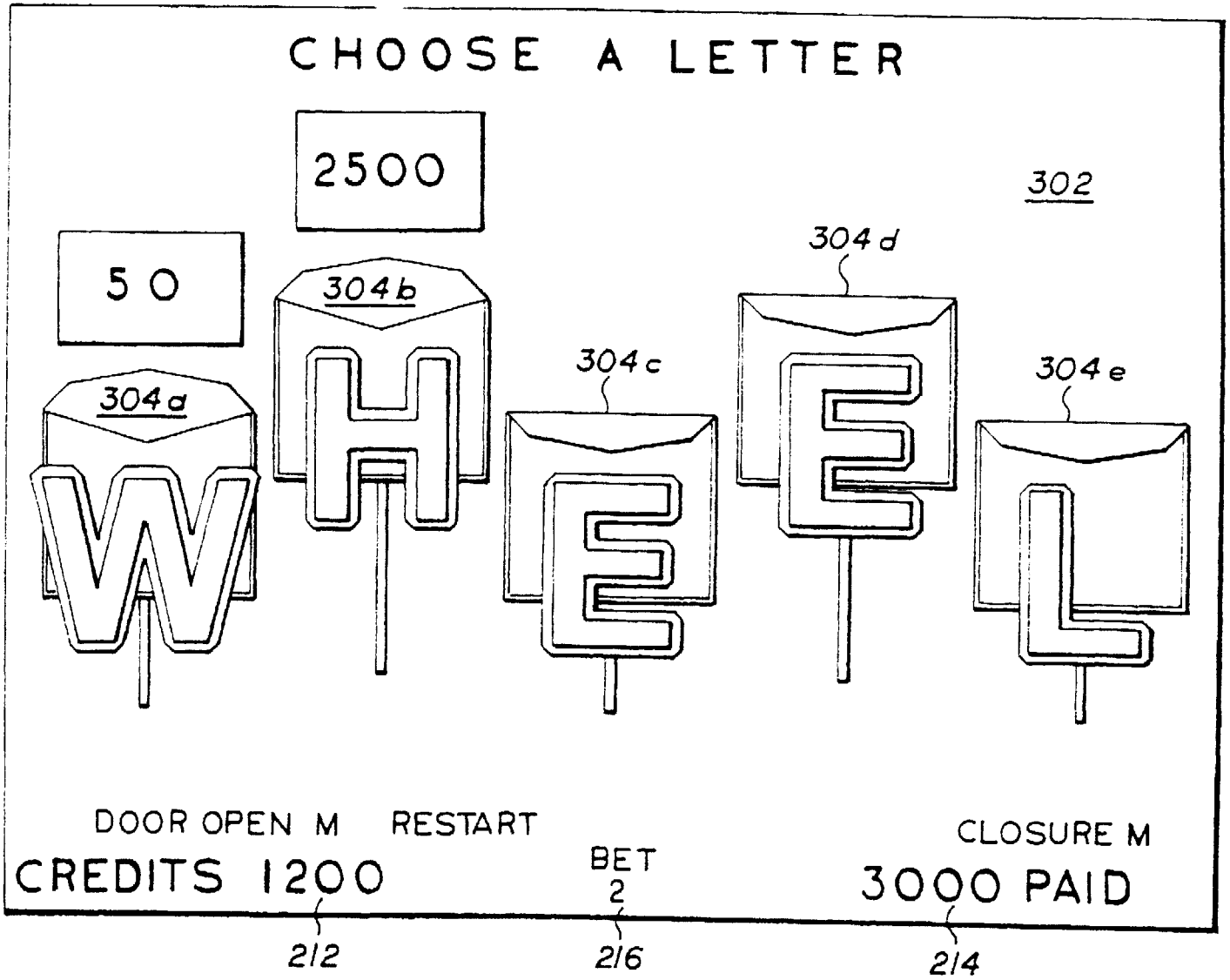
FIG. 3 shows the appearance of a display screen during a second portion of game play according to an embodiment of the present invention.

In one embodiment, as depicted in FIG. 1, game play begins when the gaming terminal is configured to display a main screen 202 (FIG. 2). The main screen may be provided with a number of displays such as a display of the denomination of the machine (i.e., the smallest coin that can be used to play a game on the gaming terminal) 204, the size of the grand prize or jackpot 206, an indication of the current status of the game 208, an indication of the number of bonus points (described below) 210, an indication of the user's current credits 212, the amount paid 214, and an indication of the current or most recent bet, such as the number of coins wagered 216. In one embodiment, bonus points do not have any monetary value but affect play of the game as described below. In one embodiment, a user may activate an input device, such as a first touch screen region 217 to obtain instructions on playing the game or other help.

In the depicted embodiment, the first portion of the game is not a simulated wheel spin game. A number of other types of games can be used for the first portion. In the depicted embodiment, the first portion game is a combination electronic slot machine and puzzle completion game. In this case, the puzzle is a word phrase; however, it could be a picture puzzle or any other type of piece by piece puzzle to be solved. A first area 218 displays regions for each letter in the phrase. In the embodiment which is depicted in FIG. 2, some of the letters are revealed (namely, all of the Rs, Ns, Es and Ts) as a result of previous play (as described below) or possibly as an automatic starting point. In the depicted embodiment, the category of the phrase is displayed 222.

A second portion of the screen 224 shows an area having some similarities to a typical electronic slot machine display, including simulated slot machine reels **226*a*, 226*b*, 226*c* and pay line indicators 228*a*, 228*b*, 228*c*, 228*d*, 228*e*. Each simulated reel region displays various indicia, such as the types of fruit, bell, bar and number symbols commonly found in electronic slot machines. In addition, indicia may be provided for use in determining whether the user may have a chance at a secondary screen video wheel spin, such as wheel indicia 236*a*, 236*b*. Associated with each payline 228 is one of a plurality of letter indicia 232*a*, 232*b*, 232*c*, with a bonus value being associated with each of the letter indicia 234*a*, 234*b*, 234*c*. A user, during display of the main screen 202, may make a wager, e.g., by depositing a coin, currency, credit card, etc. In one embodiment, a minimum number of coins or other monetary units must be deposited in order to play the game as described below. In one embodiment, the user may wager up to a maximum number of coins at a time (MAX). In one embodiment, the player may deposit between 1 and 25 coins. After the user has deposited the maximum number or has indicated (e.g., by a button or touch screen input) that the user has completed making the desired wager, the slot machine portion of the screen 224 will display a simulated slot machine handle pull, i.e., the simulated reels 226*a*, 226*b*, 226*c* (along with reels 226*d*, 226*e*) will appear to spin 112**.

After showing a simulated slot machine reel spin, the display 202 will simulate the appearance of slot machine reels that have come to rest, preferably in randomly chosen positions. If, following the reel spin, the results of the slot machine region 224 show at least a predetermined number, such as 3, of wheel indicia **236*a*, 236*b***, the user will be provided with a chance to play a wheel of fortune portion of the game as described more thoroughly below.

If the slot machine portion 224 shows a winning combination, such as three bells aligned along one of the pay lines 228 (or other combinations defined as winning combinations 116), the computer will determine 118 whether any of the letters 232 associated with such winning pay lines match any un-covered letters from the phrase 218. If there are any matches between such letters 232 and the phrase 218, all instances of that letter in the phrase are revealed in region 218. The bonus value 210 is incremented 122 by a number equal to the product of the bonus points 234 associated with that letter 232 times the number of occurrences of that letter 232 in the phrase 218 times the number of coins bet 216 on the particular pay line. In some embodiments, the user may be permitted to place bets associated with different pay lines and in that case the product will be calculated on the basis of the wagers associated with the particular winning pay lines. If, as a result of the most recent slot machine spin, there are still uncovered letters remaining in the phrase 218, the process returns to the beginning of the procedure 112 and the user has an opportunity to place another wager and spin the slot machines wheels.

If all of the letters in the phrase 218 have been uncovered, the display screen is controlled to display a bonus screen 302. The bonus screen 302 permits the user to select from among various regions of the screen, each associated with a point value. In one embodiment, the regions are depicted as envelopes 304*a*–304*e*, and the user is permitted to select (e.g., via a touch screen or other input device) a certain number of envelopes or regions with the points associated with these envelopes or regions being added to the user's credit value 212. In one embodiment, the number of envelopes or regions which the user can select depends upon how many points 210 the user had accumulated before reaching the bonus screen 302. In one embodiment, the user may select one letter if fewer than 2000 points have been accumulated, two letters for 2000 to 2999 points, three letters for 3000 to 3499 points, 4 letters for 3500 to 3599 points, and five letters for 3600 or more points. These point values may be altered and are set in accordance with the game design as determined by the game designer. Since the phrase 218 has been solved, the procedure returns to the beginning 112 so that the user can, if desired, begin a new game, with a new phrase 218. If the player, during the bonus screen 302, had more points than the minimum number of points needed for the envelopes that were selected, the excess points are used as a starting bonus value 210 for the next game or phrase 218. For example, if the player accumulated 2500 bonus points during the main game (FIG. 2), the player needed only 2000 points as the minimum necessary to select two envelopes. Thus, 500 points will be used as the starting bonus points towards the next phrase 210.

As noted above, preferably one or more results from the first, non-wheel game (FIG. 2) can be used as a "trigger" to permit the user to play a wheel game. In one embodiment, a predetermined number of special wheel symbols 236 must be displayed on the simulated slot machine region 224 in order to have a chance at the wheel game. Preferably the non-wheel game (whether it is a slot machine/phrase game as depicted, or some other game such as poker, other card games, keno, other traditional casino games or a common amusement game), provides a bounded or predetermined probability of having a chance at the wheel game as described below. In one embodiment, the non-wheel game FIG. 2 is configured so that there is a 1:50 chance of reaching the point where a wheel game may be played.

Figure 4:
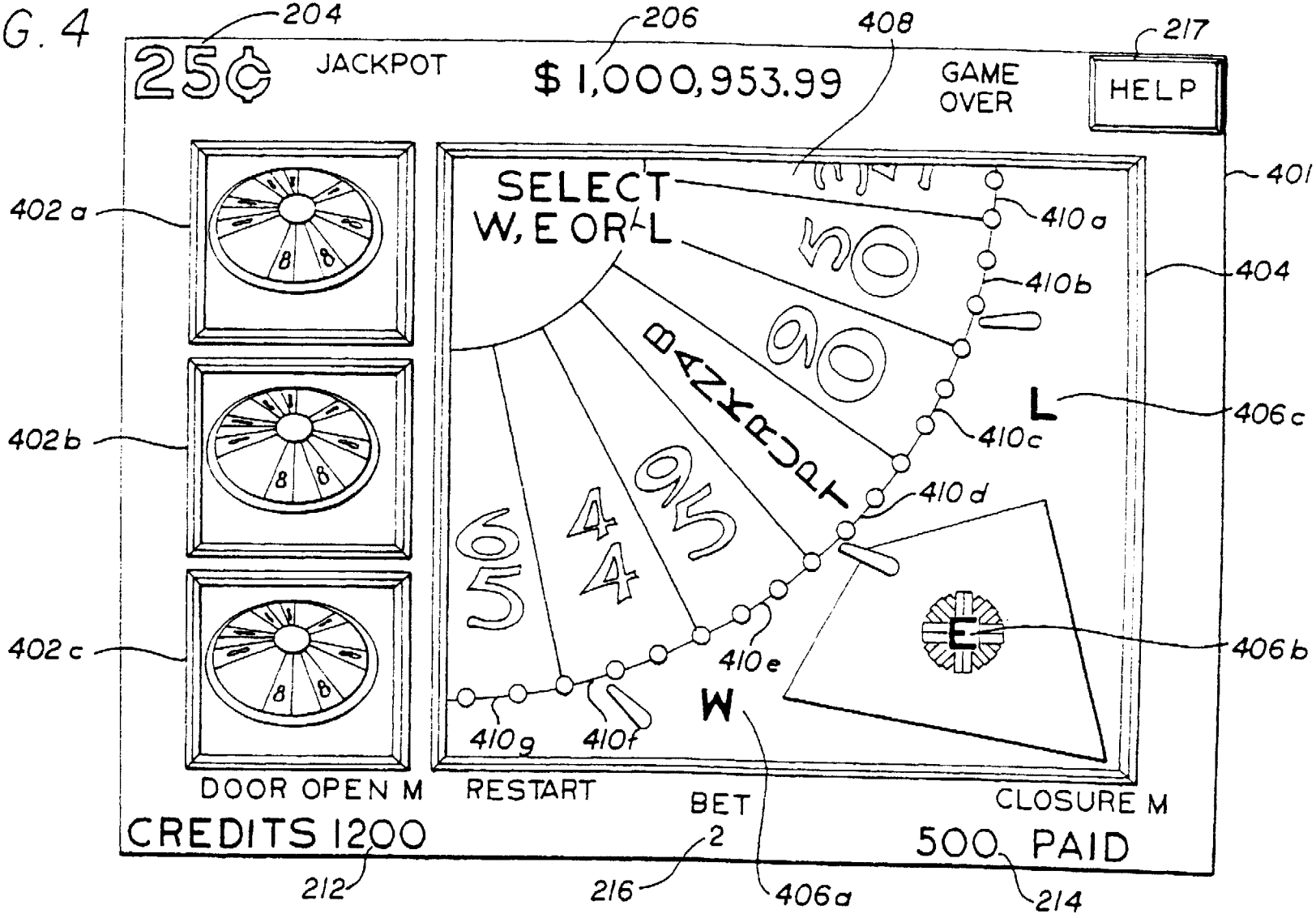
FIG. 4 shows the appearance of a display screen during a third portion of game play according to an embodiment of the present invention.

If the user obtains the result 114 which permits the user to play a wheel game, the wheel screen FIG. 4 will be shown on the display device. In one embodiment, the user may be provided with an opportunity to spin two or more simulated wheels, preferably in a hierarchical fashion, i.e., such that at least a first predetermined result must be achieved on a first wheel in order for the user to be permitted to obtain a simulated spin of the next wheel. In the embodiment of FIG. 4, first, second and third wheel indicia 402*a*, 402*b*, 402*c* can be highlighted or otherwise distinguished to show the user which wheel in the hierarchy is currently being played or spun. In the depicted embodiment, a second portion of the screen 404 shows at least a portion of the simulated wheel which is indicated by the indicia 402, preferably in a magnified view as shown. In one embodiment, there are a plurality of flippers or pointers such as three flippers associated with letters or other indicia 406*a*, 406*b*, 406*c*. In this embodiment, the user is permitted to select (via an input device such as a touch screen) which of the flippers or pointers will be the pointer used to indicate the stop position indicium of the wheel.

In the depicted embodiment the simulated wheel 408 is divided into a plurality of regions, preferably 24 evenly spaced regions. In the embodiment of FIG. 4, only 7 of the 24 regions are shown in the enlarged view at any one time.

Although the wheel 401*a* depicted on the screen 401 is a simulated wheel rather than a physical wheel, the simulated wheel 408 has certain characteristics in common with a real physical wheel of fortune. The major similarities of importance are that a plurality of indicia are associated with the wheel, the stop indicium of the wheel is randomly or pseudo randomly determined and for each indicium there is a bounded or predetermined probability that that indicium will be pointed to by the selected flipper or other indicator when the simulated wheel spin is completed. Preferably the probabilities for each of the indicia can be established independently of the number of or position of the indicia on the simulated wheel.

Figure 5:
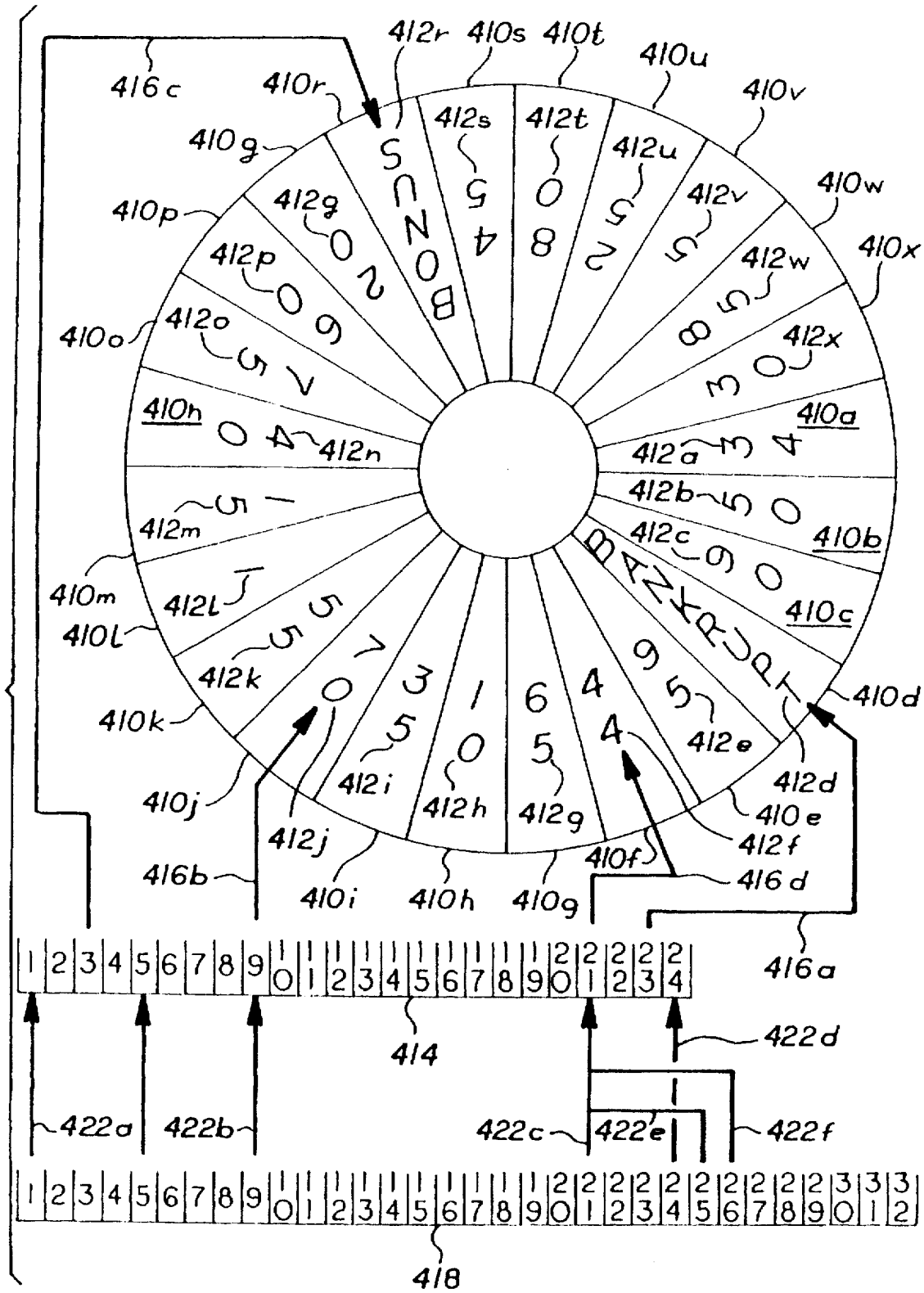
FIG. 5 is a schematic diagram showing an example of integer-to-wheel mapping according to one embodiment of the present invention.

FIG. 5 illustrates one fashion in which this independence can be achieved. As depicted in FIG. 5, in one embodiment a simulated wheel defines 24 regions 410*a*–410*x*, each associated with an indicium 412*a*–412*x*. In one embodiment, each of the 24 indicia 412*a*–412*x* is associated with an integer 414 in the range 1–24. In the embodiment depicted in FIG. 5, associations between the integers 414 in the range of 1–24 and the indicia 412 are shown by arrows 416*a*–416*d*. Although 24 arrows would be used to show all of the associations, only four arrows are depicted in FIG. 5 for clarity. The set of all such defined associations form a first mapping. Manners of defining and storing associations or mappings are well known to those of skill in the art. In one embodiment, the mapping is stored in memory as an ordered list with 24 entries, each entry identifying one of the simulated wheel spaces 410. In this embodiment a wheel spin is performed by selecting one of the numbers 414 in the range 1–24 preferably as described below, controlling the display 401 to simulate the appearance of the wheel 408 as it would appear if it were spinning and simulating the slowing down and stopping of the wheel so that the selected flipper 406 points to a region 410 bearing the indicium 412 which corresponds with the selected one of the integers 414.

If it were desired to provide the game in which the odds of landing on any one of the 24 indicia was exactly 1:24, then it would be possible to achieve such odds by randomly selecting one of the integers 414. In one embodiment, however, it is desired to have odds which are different from, preferably larger than, 1:N where N is the number of indicia shown on the simulated wheel at any one time. One manner of achieving such a result is to define a second set of integers 418 in the range 1–M where M may be different from M such as integers 1–32. Each of the second set of integers 418 is associated with or mapped onto an integer in the first group of integers 414, as shown by arrows 422*a*–422*f*. Although 32 arrows would be needed to show the full mapping or association, only six arrows are shown for purposes of clarity. Because N, the number integers in the first group 414, is smaller than M, the number of integers in the second group 418, it will be necessary for at least one of the integers in the first group 414 to be associated with more than one of the integers in the second group 418. The mapping or association can be done in any of a number of fashions as long as for every integer in the second group 418 there is an associated integer in the first group 414 which is associated with an indicium of the wheel 412. For example, the depicted embodiment integer 21 in the first group 414 is associated with 422*c*, 422*e*, 422*f*, three integers (21, 25, 26) from the second group 418. In this configuration, the computer can be programmed to randomly select an integer between 1 and 32 which is mapped onto one of the indicia 412*g* via the mapping 422 onto the integers 1–24. Several features should be noted in this regard. For an indicium 412 which is associated with a member of the first group 414 that is associated with only a single integer from the second group 418, the odds of landing on that indicium on any one spin will be 1:M. For an indicium such as 412*f* which is associated with an integer (e.g., integer 21) in the second group 414 that is associated (422*c*, 422*e*, 422*f*) with three integers (21, 25, 26) of the second group 418, the odds of landing on that indicium 412*f* will be 1:3M.

If wheel 408 is a simulated rather than a physical wheel, it is possible to modify or replace the indicium 412 associated with a region 410, merely by appropriate programming instructions. Thus, even when it is desired to have no more than a maximum number (such as 24) of regions 410 on the simulated wheel (e.g., to provide for sufficient size and clarity of the indicia on the screen) it is possible for the simulated wheel to display more than 24 indicia, not all at the same time. For example, in the embodiment depicted in FIGS. 4 and 5, region 410*g* is associated with the indicium "65" 412*g*. In one embodiment, in the display screen (FIG. 4) is controlled to simulate clockwise spinning of the wheel 408. After the view depicted in FIG. 4, the region 410*g* will move out of view as region 410*a* (and then 410*x*) moves into view. After region 410*g* has moved out of view, indicium 412*g* could be replaced by a new, 25th indicium which would be shown on the screen when region 410*g* reappears on the enlarged view 404 during the next revolution of the wheel 408. Thus it is possible in the present embodiment to provide for a number of indicia 412 on the wheel which is greater than the number of regions 410 defined for displaying the indicia at any one time.

Figure 6:
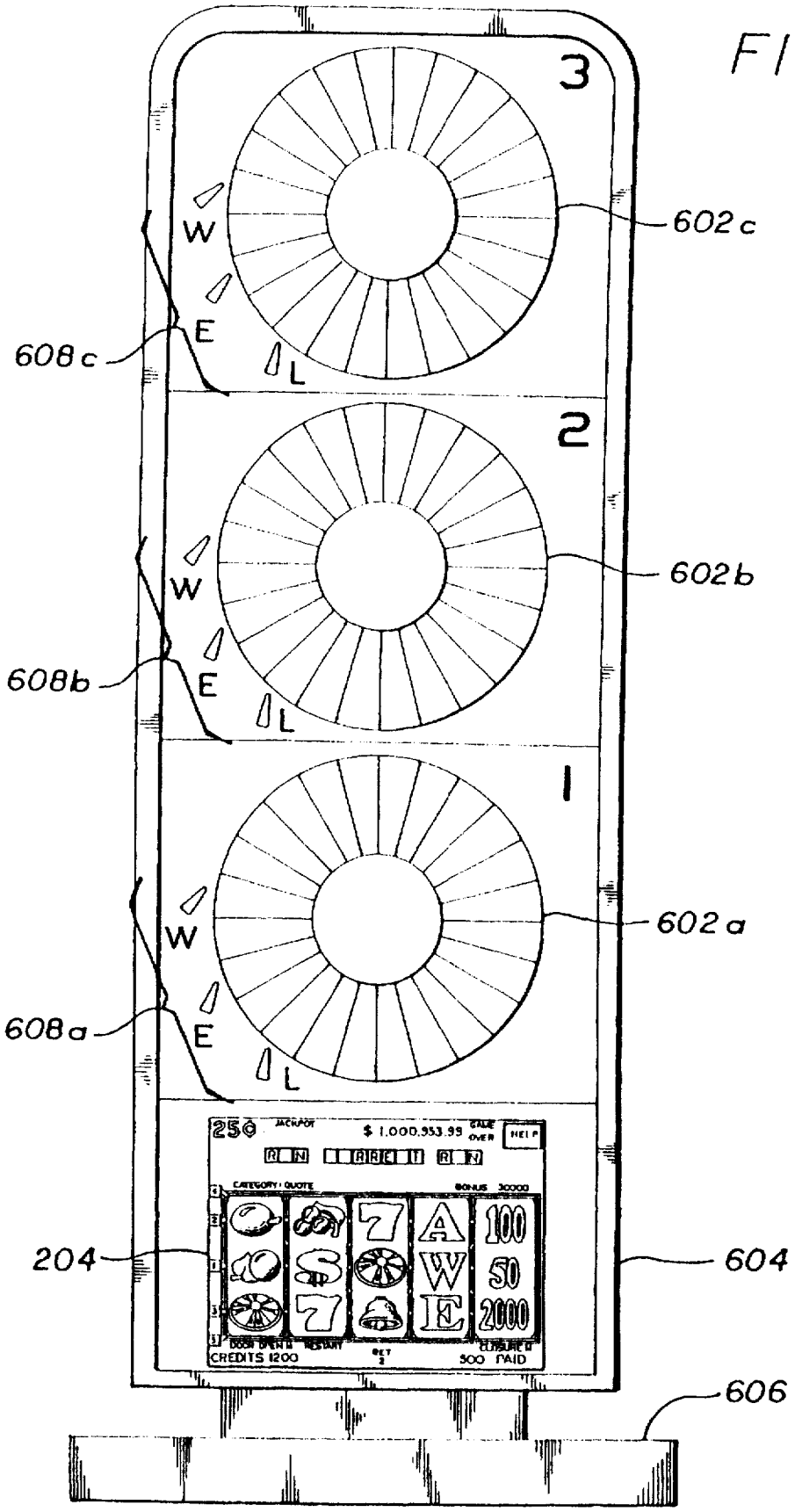
FIG. 6 shows the appearance of a device in an embodiment of the invention using physical wheels with associated virtual wheels.

It should be noted that although the use of simulated video wheels is preferred, it is possible to implement the invention using at least one physical wheel having one or more associated virtual wheels. Video wheels are preferred because of the ease with which they can be altered. In addition, they can be implemented less expensively since no extra hardware is required. However, physical wheels such as those shown in FIG. 6 could be incorporated into a machine to provide a similar level of excitement to the video wheels. As shown in FIG. 6, the same main screen 204 is used. Instead of having extra screens displaying video wheels 402, a set of physical wheels 602*a–c* is affixed to the top of cabinet 604 containing main screen 204. Cabinet 604 is set atop base 606. The play of the embodiment incorporating physical wheels 602 is the same as described above with respect to the video wheels, with the only difference being that instead of bonus screens being displayed with the video wheels, play on the physical wheels is substituted when the required events occur. For example, when the user obtains the result 114, the wheel game is activated. The user is then entitled to a wheel spin on first wheel 602*a*. If a predetermined result is achieved on first wheel 602*a* upon completion of the spin, the user is entitled to a spin on second wheel 602*b*. Finally, if a predetermined result is achieved upon the completion of the spin of second wheel 602*b*, the user is entitled to a spin on third wheel 602*c*. Flippers 608*a–c* for each wheel, similar to those depicted on the simulated video wheels, are positioned on the physical wheels 602*a–c* to determine the selected position after the spin is completed.

In an embodiment in accordance with FIG. 6, it is also possible to replace main screen 204 with physical spinning reels as used in standard slot machines. An example of a standard slot is one that is manufactured by International Game Technology of Reno, Nev.

Returning to FIG. 1, when the user reaches the wheel game depicted in FIG. 4, the large view of the wheel is displayed 404 the indicium 402*a* corresponding to the wheel which is being spun, wheel number 1, is highlighted, the user selects one of the flippers 406*a*, 406*b*, 406*c* and a simulated wheel spin is displayed. The wheel stops so that the selected flipper 406 points to a randomly or pseudo-randomly selected indicium (selected as described above) 132. Preferably, one of the indicia 412*d* is a "bankrupt" or other losing indicium and if the selected flipper 406*b*points to this indicium, play returns to the beginning of the game 112.

If it is determined that the indicium pointed at by the selected flipper 406 is not a losing indicium, it is next determined whether the selected flipper 406 points to a bonus indicium 412. Although in the embodiment in FIG. 5, only a single bankrupt indicium and a single bonus indicium is depicted, a wheel may be provided with more or fewer bankrupt and/or bonus indicia.

Preferably, indicia which are not "bankrupt" or "bonus" are associated with a numerical value 412*a*, 412*b*, 412*c*, 412*e–*412*q*, 412*s–*412*x*. If the wheel lands on neither the bonus nor bankrupt indicium, the credit value 212 is preferably incremented by the amount associated with the indicium 412 times the number of coins played 216 and the procedure then returns to the beginning 112.

If the wheel landed on a bonus indicium 136, the second wheel indicium 402*b* is highlighted and the player is provided with a spin of the second wheel. In one embodiment, the second wheel is similar to the first wheel but preferably does not contain a bankrupt indicium 412*d* and preferably contains indicium values 412 which are larger than (such as twice) the amount of the first wheel values. Thus, after reaching the second wheel spin, the second wheel indicium 412*b* is highlighted, user selects a flipper 406 and the simulated wheel spin is displayed 142. If the wheel does not land on a bonus indicium 412*r*, the credit value 212 is incremented 146 by the amount of the bonus indicium on the second wheel times the number of coins bet 216 and play then returns to the beginning 112.

If the second wheel resulted in a bonus indicium 412*r*, the wheel number three indicator 402*c* is highlighted, the user selects a flipper 406 and simulated spin at the third wheel is displayed. Preferably the third wheel has no bankrupt indicium 412*d* and the values associated with the indicia 412 are larger (such as 10 times) those on the first wheel. If the player does not land on the bonus indicium 412*r* of the third wheel, the credit value 212 is incremented by the wheel amount times the number of coins played 216 and the player receives a payout equal to the amount of the indicium 412 pointed to by the selected flipper 406 times the number of coins bet 216. If the player lands on a bonus indicium 412*r* on the third wheel spin it is determined 162 whether the player had bet the maximum number of coins (MAX) 216. If not, the player is paid some multiple of the number of coins bet 216, such as 10,000 times the number of coins bet 164. If the player has bet the maximum number of coins 216 the player is awarded a top award jackpot prize 206 166. In either case, player then returns to the beginning 1 12.

The game may be set up as a stand alone machine capable of paying out set prize values for winning combinations on pay lines 228*a–e* for reels 226*a–e*, or a particular selected wheel portion 410 during respective portions of the game process. The top award jackpot prize may also be a set value that is more than any other prize. However, in a preferred embodiment of the invention, the top award jackpot prize is a progressive value that increases as a function of each coin deposited in the machine. Such a value 206 is shown on main display screen 204. The progressive machine may be operated as a stand alone unit, or preferably in a linked manner to other similar games throughout a particular gaming jurisdiction. For example, if 1000 machines are linked together such that a portion of each coin deposited in each machine increases the top award jackpot prize amount as a function of the coin in for each machine, the top prize is capable of reaching figures in the millions of dollars. Linked progressive systems of this type are known in the gaming industry such as International Game Technology's Megabucks® that has reached top award jackpot prizes of more than $10 million.

In one embodiment, a first game portion provides a 1:50 chance of having an opportunity to spin a first wheel, the first wheel provides a 1:20 chance of having an opportunity at a second wheel, a second wheel provides a 1:40 chance of having an opportunity at a third wheel, and a third wheel provides a 1:200 chance of winning a jackpot to achieve overall odds (i.e., the product of the odds for all game portions) of 1:8,000,000 to win the jackpot in game having three wheel spins. 1:8,000,000 is obtained by multiplying the combined odds, i.e. 50×20×40×200=8,000,000. The overall odds for the jackpot can be adjusted in a number of ways, e.g., by changing the number of wheel spins involved in winning the jackpot, and/or by changing the odds of any particular wheel spin giving an opportunity at the next wheel in the hierarchy (such as by adjusting the mapping from the range of integers to the simulated wheel indicia).

In light of the above description, a number of advantages of the present invention can be seen. The present invention provides a game which includes aspects of the familiar Wheel of Fortune game which is attractive to many players but which overcome some of the limitations of a traditional wheel of fortune game. The present invention achieves 1:K odds of landing on a jackpot—winning indicium of the simulated wheel where K is greater then the total number of indicia on the wheel, K is preferably a large number such as 1,000,000 preferably 5,000,000 and more preferably 8,000,000 or more. In one embodiment a mapping between groups of integers is provided such that the odds of landing on any one indicium are different from 1:J where J is the number of indicia (preferably evenly spaced indicia) on the simulated wheel. In one embodiment, odds of winning a grand prize or jackpot are adjusted by providing a game in which spins of several different wheels are provided and wherein the wheels are hierarchically related such that the results of a spin of one wheel affect the either ability to spin or the results from a spin of a succeeding wheel.

A number of variations and modifications can also be used. Although the present disclosure describes an embodiment having three wheel spins in a hierarchy, it is also possible to provide more or fewer wheel spins in a multiple wheel hierarchy. Although in the described embodiment, each wheel in the hierarchy is different (such as having different values associated with the indicia and/or different odds of landing on a bonus indicium) an embodiment could be provided in which all wheels provide identical values, indicia and/or odds or different virtual wheels can be assigned to the same simulated or physical wheel depending on the level of the hierarchy a player attains. In addition, although the above described embodiment provides for a first slot machine/phrase completion game combined with the wheel game, it is possible to combine a wheel game with other types of games such as a keno game, a blackjack game, a poker game and the like, or to provide a game which is strictly a hierarchy of wheels or a single wheel, without combining with a game of another type. Further, it is possible to implement the invention in other ways by displaying ranges of indicia without the use of a wheel. For example, a line of values could be displayed and an indicator arrow could move along the line. The movement could be back and forth along the line or with the use of a wrap-around effect upon reaching the end of the line.

Although the invention has been described by way of a preferred embodiment and certain variations of modifications, other variations and modifications can also be used, if the invention being defined by the following the claims:

What is claimed is:

1. A game process, implemented using a computer, comprising:

receiving a monetary wager from a player;

controlling a first display device to display an image of at least a portion of a first simulated value range, said image, during at least a first period of said display, containing a first plurality of indicia including at least one indicium designated as a next level indicium, at least some of said plurality of indicia, upon being displayed, indicating loss of at least part of said monetary wager; and upon the next level indicium being selected on the first simulated value range during the first period, controlling a display to show at least a portion of a wheel of fortune rotatable about a first axis, said wheel having a plurality of prize indicators on a face thereof and situated adjacent at least a first pointer for indicating exactly one of said prize indicators after rotation about said first axis has stopped, all of said prize indicators indicating the size of the prize won by said player as a result of said next level indicium wherein no loss of a part of said monetary wager results from any of said prize indicators, said plurality of prize indicators including at least one top award indicium.

2. A method as claimed in claim 1 wherein said first simulated value range does not contain a top award indicium.

3. A method as claimed in claim 1 wherein the overall odds that said indicator points to said top award indicium is at least 1:1,000,000.

4. A method as claimed in claim 1 wherein said first simulated value range contains J indicia where J is an integer, further comprising:

storing, in said computer, information defining a mapping between integers 1 through J, corresponding, respectively to said J indicia, and integers 1 through M where M is an integer greater than or equal to J;

randomly selecting a first integer between 1 and M designated as x; and controlling said display device to simulate selection of an indicia in said first simulated value range wherein x is mapped to at least one position that corresponds to a display position y between the range 1 and J; and displaying an indicium located at said display position y on the first display device.

5. The method of claim 1 wherein the top award represented by the top award indicium progresses as a function of coin in deposited.

6. The method of claim 5 wherein the top award represented by the top award indicium progresses as a function of coin in deposited from a plurality of devices on which the method is being conducted.

7. A process as claimed in claim 1 wherein said wheel of fortune comprises a physical wheel.

8. A process as claimed in claim 1 wherein said wheel of fortune comprises a display on a video display screen.

9. A process as claimed in claim 1 wherein said wheel of fortune is controlled so at to stop at a position which is random, independent of the skill of the player.

10. A process as claimed in claim 1 wherein said wheel of fortune is computer controlled so as to stop at a position randomly selected by said computer.

11. A process as claimed in claim 1 wherein, when N represents the number of stop positions of said wheel of fortune, said wheel of fortune is computer controlled so that the odds of stopping at a particular stop position are different from 1/N.

12. A process as claimed in claim 1 wherein said game process includes the award of at least one progressive prize.

13. A process as claimed in claim 12, wherein said progressive prize is awarded in response to a predefined stop position of said wheel of fortune.

14. Apparatus under computer control, comprising:

a first gaming apparatus which includes a first display device for displaying a game of chance;

a first value wheel activated for a first time period upon a random event occurring in the game of chance, the first value wheel including at least one next level indicium; and a second value wheel activated for a second time period upon the next level indicium being selected upon completion of the first time period, the second value wheel including at least one top award indicium.

15. The apparatus of claim 14 further comprising:

at least one second gaming apparatus; and a system for linking the at least one second gaming apparatus with said first gaming apparatus such that a top award jackpot prize represented by the top award indicium progresses as a function of coin in deposited into said first gaming apparatus and the at least one second gaming apparatus linked together in the system.

16. A gaming apparatus under computer control, comprising:

means for receiving a monetary wager from a player;

a first display device for displaying a game of chance which includes the potential for losing at least a portion of said monetary wager;

a wheel of fortune activated for a first time period upon a random event occurring in the game of chance, the wheel of fortune rotatable about a first axis, wherein said wheel of fortune is controlled so as to stop at a random stop position, independent of the skill of the player, said wheel of fortune having a plurality of prize indicators on a face thereof and situated adjacent at least a first pointer for indicating exactly one of said prize indicators after rotation about said first axis has stopped, all of said prize indicators indicating the size of the prize won by said player as a result of said random even wherein no loss of a part of said monetary wager results from any of said prize indicators.

* * * * *

UNITED STATES PATENT AND TRADEMARK OFFICE
Certificate

Patent No. 5,788,573 Patented: August 5, 1998

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Anthony J. Baerlocher, Carson City, Nevada; Robert W. Crowder, Reno, Nevada; and Yin Zin Mark Lam, Reno, Nevada.

Signed and Sealed this Seventeenth Day of December 2002.

S. THOMAS HUGHES
*Supervisory Patent Examiner*
Art Unit 3714